United States Patent [19]

Chou et al.

[11] Patent Number: 4,921,596

[45] Date of Patent: May 1, 1990

[54] CATALYTIC CRACKING PROCESS WITH REDUCED PRESSURE STRIPPING

[75] Inventors: Tai-Sheng Chou, Pennington, N.J.; Paul H. Schipper, Wilmington, Del.

[73] Assignee: Mobil Oil Corporation, New York, N.Y.

[21] Appl. No.: 301,768

[22] Filed: Jan. 26, 1989

Related U.S. Application Data

[63] Continuation-in-part of Ser. No. 89,657, Aug. 26, 1987, abandoned.

[51] Int. Cl.[5] ..... C10G 11/18

[52] U.S. Cl. ..... 208/113; 208/151; 208/155; 208/161; 208/164

[58] Field of Search ..... 208/113, 120, 161, 164, 208/150, 151, 155

[56] References Cited

U.S. PATENT DOCUMENTS

| | | | |
|---|---|---|---|
| 2,502,953 | 4/1950 | Jahnig | 208/155 |
| 2,502,954 | 4/1950 | Blanding | 208/151 |
| 2,671,102 | 3/1954 | Jewell | 208/164 |
| 2,791,542 | 5/1957 | Nathan | 208/151 |
| 2,919,243 | 12/1959 | Degnen | 208/150 |
| 2,965,454 | 12/1960 | Harper | 208/151 |
| 4,424,116 | 1/1984 | Hettinger, Jr. | 208/120 |
| 4,464,250 | 8/1984 | Myers et al. | 208/150 |
| 4,738,829 | 4/1988 | Krug | 422/144 |
| 4,789,458 | 12/1988 | Haddad et al. | 208/164 |

*Primary Examiner*—Anthony McFarlane

*Attorney, Agent, or Firm*—A. J. McKillop; C. J. Speciale; R. D. Stone

[57] ABSTRACT

The present invention describes improved FCC and TCC stripper operations by incorporating a stripper operated at a reduced pressure. The improved strippers of the invention will increase total liquid hydrocarbon yield while reducing the coke load on the regenerator. Novel porous TCC bead catalysts are disclosed wherein at least ⅓ of the pore volume of catalyst pores having a pore diameter of at least 3000 Angstroms. These macropores facilitate flash vaporization of hydrocarbons in a stripping zone of the spent catalyst upstream of a regeneration zone.

9 Claims, 3 Drawing Sheets

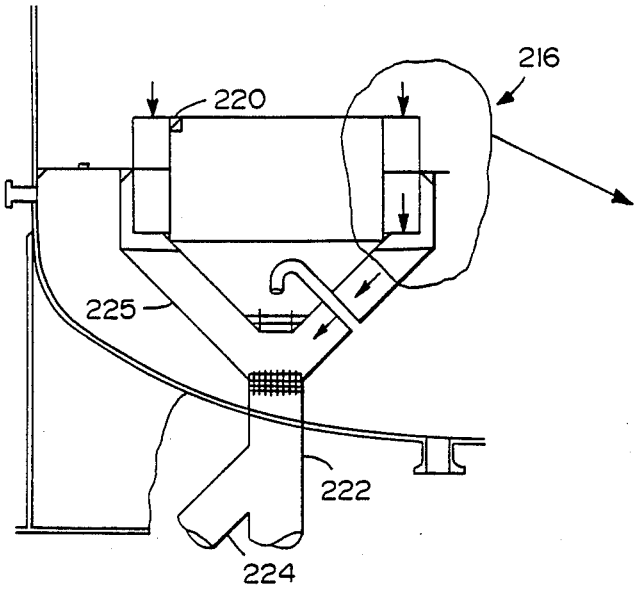
FIG. 3
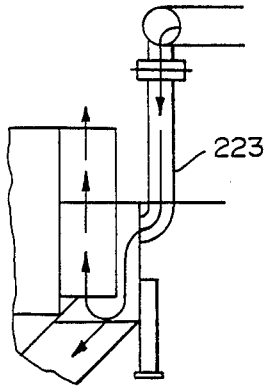
FIG. 3A
FIG. 4
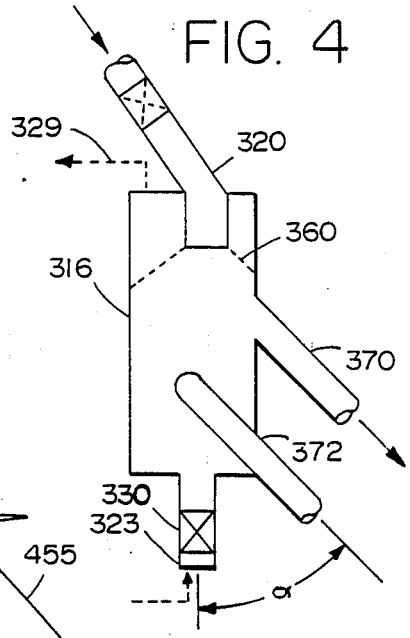
FIG. 5
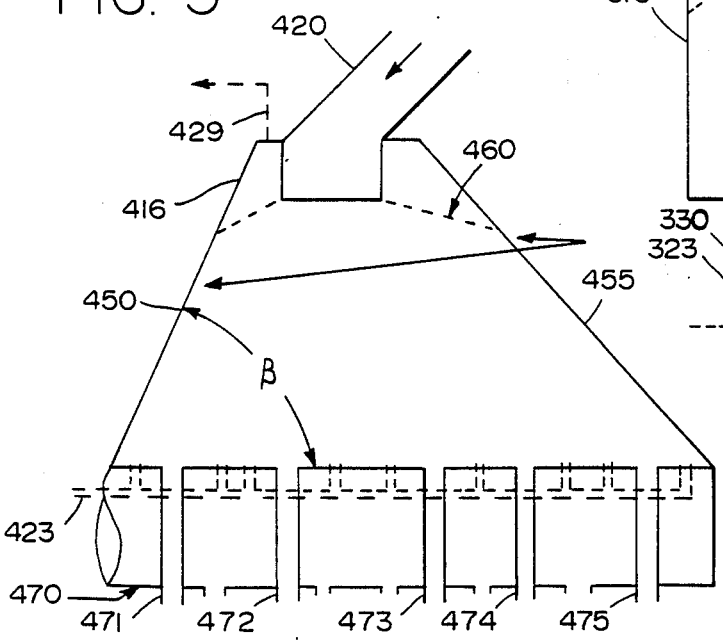

CATALYTIC CRACKING PROCESS WITH REDUCED PRESSURE STRIPPING

CROSS-REFERENCE TO RELATED APPLICATIONS

This application is a continuation-in-part of copending application, Ser. No. 089,657, filed on Aug. 26, 1987, now abandoned.

BACKGROUND OF THE INVENTION

Field of the Invention

This invention is concerned with catalytic cracking processes wherein coke containing catalyst is stripped prior to coke burn-off.

The field of catalytic cracking has undergone progressive development since 1940. The trend of development from the Thermofor catalytic cracker (TCC) to the widespread use of the fluid catalytic cracking (FCC) process is evident from both patent and technical literature. The trend in FCC processes has been to all riser cracking, use of zeolite-containing catalysts, heat balanced operation, and complete combustion of CO to $CO_2$ within the regenerator.

Although new production facilities favor the installation of FCC units, existing TCC units are currently in use throughout the world. A conventional TCC unit is described and illustrated in U.S. Pat. No. 4,473,658, the disclosure of all of which is herein incorporated by reference. Although the TCC process varies from refinery to refinery, all installations use 4 to 20 Tyler mesh size particles of a high surface area, inorganic porous acidic solid as catalyst; all operate in the absence of added hydrogen; all utilize a continuous feed of the stream to be cracked, as well as a continuous cyclical transport of an active inventory of catalyst between a regenerator zone and a cracking zone.

Major trends in FCC and TCC processing have included modifications to accommodate feedstocks that contain more metals and sulfur and attempts to improve catalyst stripping.

Higher sulfur levels in the feed, combined with a more complete regeneration of the catalyst in the regenerator, increase the amount of $SO_X$ in the regenerator flue gas.

Refiners have long known that conventional primary strippers are somewhat inefficient and leave large amounts of potentially recoverable or strippable hydrocarbon on the spent catalyst. They know that permits 10–50 percent of the burning in an FCC regenerator is of potentially recoverable cracked product, rather than catalytic coke. Although the industry has long known this problem, no one has come up with a completely satisfactory solution.

One of the constraints of operating a conventional, primary FCC stripper is the pressure balance. Usually the FCC stripper is at the base of a reactor vessel. Frequently spent catalyst is stripped in an annulus about the riser reactor. The pressure above the stripper is the same as the pressure at the reactor riser outlet. It is not possible to operate the reactor stripper at a pressure lower than the reactor outlet, because both share a common vapor space and must operate at the same pressure.

It is not possible to simply provide an extra, secondary stripper operating at a low pressure intermediate the primary stripper and the regenerator. Although it is theoretically possible to take material from the primary stripper and discharge it into a secondary stripping vessel, and operate this secondary stripping vessel at a reduced pressure, it would not be possible to easily transport catalyst from this mythical, reduced pressure, secondary stripper to the FCC regenerator.

Accordingly, the art has not developed a secondary stripper which operates at a reduced pressure relative to both the FCC reactor and to the FCC regenerator.

Some attempts have been made to reduce the amount of sulfur fed to the regenerator of an FCC unit by improving stripping. In U.S. Pat. No. 4,481,103, which is incorporated by reference, the spent catalyst was contacted with steam at about 500° to 700° C. for about one-half to 10 minutes, preferably 1 to 5 minutes, in the absence of oxygen, during a stripping step. This became known as the "long residence time stripper." After this stripping, the stripped catalyst was regenerated with an oxygen-containing gas at FCC regeneration conditions sufficient to convert most of the coke deposited on the catalyst to carbon dioxide to produce a regenerated catalyst.

A high temperature stripper is described in U.S. Pat. No. 4,424,116 which is incorporated by reference. A spent, coke-laden catalyst is mixed with a portion of hot regenerated catalyst then passed through a first stripping zone comprising an elongated chamber, which is at least in part vertical or inclined, for a residence time sufficient to remove some of the hydrocarbons on the spent catalyst.

The mixture of regenerated and spent catalyst is then separated from the gaseous stream, and introduced into a second stripping zone and again contacted with a stripping gas. After the second stripping operation the catalyst is again separated from the stripping gas and regenerated. The regenerated catalyst is quite hot, being about 650° C., preferably at least about 675° C., more preferably 705° C. and most preferably at least about 720° C. Thus, the temperature difference between the regenerated and spent catalyst will be at least about 55° C. up to about 195° C.

The stripping gas, recovered from the second stripping zone stripper is preferably combined with the cracked product from the reactor. This restricts the operating pressure of this secondary stripper to about the riser top pressure.

U.S. Pat. No. 2,965,454 (Harper) discloses a down flow dilute phase catalytic cracking process, followed by further dense bed cracking of heavy feed (including liquid) in a dense bed reaction zone labeled as a "first stripper". Spent catalyst withdrawn from the "first stripper" was carried up a riser with steam and discharged into a second stripper where occluded hydrocarbon conversion products are stripped with stripping steam. Stripped catalyst then flowed horizontally into a catalyst regenerator, which operated at essentially the same pressure and at the same elevation as the second stripper.

The second stripper 23 would operate at a reduced pressure relative to the "first stripper" 11, but the "first stripper" 11 would not function as a true stripper because it functions as a dense bed cracking zone wherein heavy liquid is cracked to lighter products with resulting deposition of coke upon catalyst therein. The second stripper would operate at a lower pressure relative to the "first stripper", and the second stripper would be sorely needed because cracked products are generated in the "first stripper" 11 and would be present in the "stripped catalyst".

Another limitation on the approach described in the '454 patent is that the second stripper operates in pressure balance with the regenerator 29. If an attempt were made to operate the second stripper 23 at a lower pressure than the regenerator 29, it would not be possible to get catalyst to flow from the second stripper 23 via line 28 into regenerator 29. This constraint, namely that the second stripper must operate at a pressure essentially equal to that of the regenerator, limits the benefits obtainable by such a process.

Thus, the prior art attempts at removing hydrocarbons from spent catalyst in a stripping operation have concentrated either on long residence time as in U.S. Pat. No. 4,481,103 or extremely high temperatures as in U.S. Pat. No. 4,424,116. These attempts have not been entirely satisfactory.

BRIEF SUMMARY OF THE INVENTION

Accordingly, the present invention provides a process for the fluidized catalytic cracking of a heavy hydrocarbon feed by contacting the feed with a source of hot, regenerated catalyst at catalytic cracking conditions in an upflow, riser reactor to form a mixture of cracked products and spent catalyst containing coke and strippable hydrocarbons, which mixture is discharged from the riser reactor at a riser outlet pressure and separated into a cracked product vapor phase and a spent catalyst phase comprising a dense phase fluidized bed, and said spent catalyst is stripped in a primary stripper by contact with a stripping gas at spent catalyst stripping conditions including a primary stripping pressure to produce a stripped catalyst with a reduced content of strippable hydrocarbons, and said stripped catalyst is charged to a catalyst regeneration zone operating at catalyst regeneration conditions including a regenerator pressure to produce hot, regenerated catalyst which is recycled to the base of the riser to crack said feed characterized in that a secondary stripper is provided intermediate said primary stripper and said regenerator, and said secondary stripper is operated at a reduced pressure relative to both said primary stripper and said regenerator pressure and said secondary stripper removes additional strippable hydrocarbons from said catalyst by contacting said stripped catalyst with a stripping gas stream at stripping conditions including said reduced pressure.

In another embodiment, the present invention provides an apparatus for the fluidized catalytic cracking of hydrocarbons comprising: a catalyst regenerator at an elevation having an inlet for a source of regeneration gas, an inlet for stripped catalyst, a flue gas outlet, and a regenerated catalyst outlet; a riser reactor having an inlet at the base thereof for a heavy hydrocarbon feed and an inlet for a source of hot regenerated catalyst connective with said regenerator catalyst outlet and a riser reactor outlet within a reactor vessel for discharge of spent catalyst and cracked products; a spent catalyst/cracked product separation means connective with said riser outlet for separation of cracked products and spent catalyst exiting the riser into a cracked product phase and a spent catalyst phase which contains strippable hydrocarbons; a primary catalyst stripping means beneath said riser reactor outlet having an upper inlet for accepting said spent catalyst phase, at least one stripping gas inlet at a lower portion of said stripping means, an upper outlet connective with said reactor vessel for discharge of stripped cracked products, and a stripped catalyst outlet; a secondary catalyst stripping means, adapted to contain a dense phase fluidized bed of catalyst, at an elevation above said primary stripping zone and above said catalyst regenerator, said secondary stripper having an inlet for catalyst, and inlet for a secondary stripping gas, an outlet for stripped vapor, and an outlet for stripped catalyst; a stripped catalyst lift means connective at a lower portion thereof with the stripped catalyst outlet from the primary stripper and at an upper portion thereof with the secondary catalyst stripping means, said lift means being adapted to transport catalyst from said primary stripper to said secondary stripper; and a stripped catalyst standpipe having an upper inlet connective with said outlet for stripped catalyst from said secondary stripper and a lower outlet connective with said catalyst regenerator.

BRIEF DESCRIPTION OF THE DRAWINGS

FIG. 3 is a schematic representation of a prior art stripper for a TCC unit;

FIG. 3A is an enlarged schematic represention of a portion of the stripper shown in FIG. 3;

FIG. 4 is a schematic representation of one embodiment of a secondary TCC stripper unit according to the invention;

FIG. 5 is a schematic representation of a further embodiment of a secondary TCC stripper unit according to the invention;

DETAILED DESCRIPTION OF THE INVENTION

The FCC Catalyst

Any conventional FCC catalyst can be used. Use of zeolite catalysts in an amorphous base is preferred. Many suitable catalysts are disclosed in U.S. Pat. No. 3,926,778, which is incorporated by reference.

The FCC Reactor

Figure 1:
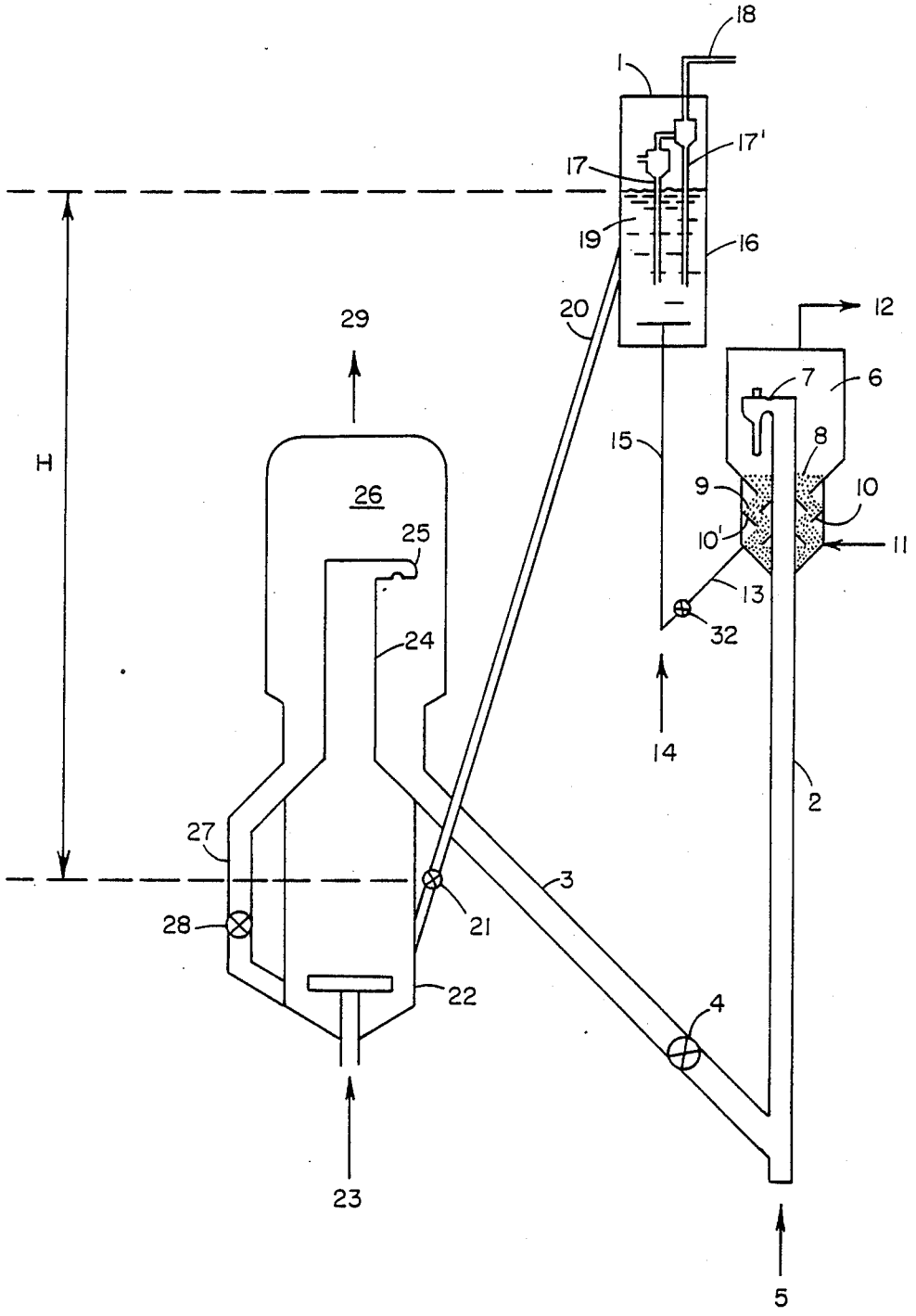
FIG. 1 is a simplified schematic representation of one embodiment of the present invention showing a conventional riser reactor of an FCC unit in combination with the secondary stripper of the present invention and a regenerating unit.

Although a riser reactor is preferred and is shown in the drawing, any conventional FCC reactor can be used. The FCC reactor preferably contains a conventional stripping zone in the bottom of the reactor, as shown in FIG. 1, or immediately outside of the reactor as shown in U.S. Pat. No. 3,838,036, which is incorporated by reference.

The process of the present invention is applicable to any modern, relatively short residence time cracking process wherein a heavy hydrocarbon feed is vaporized by contact with hot regenerated catalyst, and cracked to lighter products.

The FCC process is primarily a vapor phase process. The hydrocarbon feed is usually added to the base of a riser reactor as a liquid and vaporized and cracked by the hot regenerated catalyst. Usually the riser residence time is on the order of 1–10 seconds. The riser reactor may, but preferably does not, discharge into a dense bed reaction zone where further cracking reactions can taken place. Today most FCC operators prefer all riser cracking, with little or no dense bed cracking.

To achieve good stripping, discussed at greater length below, it is essential that at the riser reactor outlet, or in the dense bed reactor, if present, that all of the feed be present as vapor.

The FCC Primary Stripper

The FCC process operates with large amounts of catalyst relative to oil. 1–10 weights of catalysts per weight of oil feed are used in many units, with most operating with cat:oil ratios of around 3:1 to 5:1. Much of the valuable cracked product remains with the catalyst. For this reason, all catalytic cracking units include a stripping section wherein a stripping stream, usually steam, contacts the mixture of spent catalyst/cracked products to displace cracked products from the spent catalyst. This not only increases the recovery of valuable cracked products, but minimizes the burning load in the FCC regenerator. Any hydrocarbons which remain on cracked catalysts after stripping are simply burned in the regenerator. Burning these hydrocarbons increases the load on the regenerator. Burning of hydrocarbons also produces a lot of water of combustion. FCC regenerators typically operate with a 3–15 psia steam partial pressure. The steam comes from water of combustion, and to a lesser extent from entrained stripping steam. The relatively high steam partial pressures in the regenerators cause hydrothermal degradation of the zeolite catalyst preferred for use in FCC units.

Preferably, the primary stripper is in a generally elongated, vertical vessel. The catalyst to be stripped should be maintained as a generally dense bed, with most of the steam added at the base of the stripper. It is possible to provide for multiple points of injection of steam, and multiple points of withdrawal of stripped cracked product.

Preferably the primary stripper has an L/D or length/diameter ratio greater than 1, and most preferably in the range of 1.5:1 to 5:1. The primary stripper functions more efficiently when it has such a generally vertical geometry, i.e., problems of stripping gas bypassing are minimized.

The FCC Regenerator

The FCC regenerator is conventional. The regenerator can operate in a CO burning mode in a single vessel, as shown in U.S. Pat. No. 4,238,317 or a dual vessel may be used such as disclosed in U.S. Pat. No. 3,926,778, which are incorporated by reference. Other conventional FCC regenerators include those operating in a non-CO burning mode of operation, in which coke is combusted to a mixture of CO and $CO_2$. These regenerators may not do as thorough a job regenerating the catalyst, and the $SO_x$ emission problems are somewhat less with these type regenerators, as opposed to CO burning regenerators, but the practice of the present invention will still be of some benefit even in these older FCC regenerators.

FCC Secondary Stripper

Any conventional catalyst/gas contacting vessel which will permit mixing of FCC spent catalyst from the reactor with a stripping gas, preferably steam, at a reduced pressure is suitable. However, contrary to the long residence time stripper as disclosed in U.S. Pat. No. 4,481,103, the present invention does not require increased catalyst inventory in that the residence time in the stripping vessel is relatively short, i.e., on the order of about 10 to about 100 seconds. Furthermore, unlike the invention disclosed in U.S. Pat. No. 4,424,116 the temperature of the catalyst in the stripper is relatively low, i.e., less than 565° C., and typically about 525° C.

THE TCC CATALYST

TCC catalyst beads are generally well known in the art such as those disclosed in U.S. Pat. No. 4,473,658, the disclosure of all of which is herein incorporated by reference.

Generally the beads comprise a metal-containing synthetic bead catalyst containing at least one metal from the group consisting of platinum, palladium, iridium, osmium, rhodium, ruthenium, and rhenium, the platinum-promoted synthetic bead catalyst, being preferred. The catalyst preferably contains dispersed metal in a concentration of about 4 ppm. The catalyst itself comprises a crystalline aluminosilicate zeolite having a typical pore diameter of 6 to 15 Angstroms.

Preferably the TCC catalyst has an improved pore size distribution for an enhancement of the hydrocarbon removal from the kiln. Hydrocarbon captured by the pores of a catalyst having pore diameters greater than about 3000 Angstroms can be removed from the top catalyst layers of the kiln into the top stack of a TCC apparatus. This convective transport of the hydrocarbon in the porous catalyst will also promote flash vaporization in the connecting micropores of the catalyst. Consequently, the residual hydrocarbon trapped in the porous catalysts a few layers down in the kiln will be significantly reduced.

Such a catalyst provides the following benefits:

(i) Clean burn regenerated catalyst
(ii) Reduced coke burning requirement for the kiln
(iii) Improved hydrothermal stability of the equilibrium catalyst by a reduction in the water partial pressure and kiln temperature.

Secondary Stripper For The TCC Unit

Stripping at a reduced pressure for the TCC unit can be conveniently performed either near the depressurizing legs situated between the reactor and the kiln, as shown in FIG. 4, or at the top of the kiln, as shown in FIG. 5. The efficiency of the hydrocarbon removal can be enhanced by utilizing this reduced pressure stripping.

Preferred Embodiment of the Invention

In FIG. 1, an oil feed is introduced to the base of FCC riser reactor 2 where it is mixed with hot regenerated catalyst which enters the riser via line 3 and flow control valve 4. The oil chargestock 5 enters the base of riser reactor 2 where it contacts the hot regenerated catalyst and the catalyst and oil rise as a dilute phase mixture through riser 2 entering separation zone 6 above the riser discharge. The riser may discharge into a cyclone separator 7, or there may be one or more cyclone separators (not shown) above the riser. It is preferred to quickly separate hydrocarbons from catalysts, and for this reason, the riser preferably discharges directly into a cyclone separator 7 as shown in FIG. 1. The catalyst particles separated by cyclone separator 7 form a dense bed of catalyst 8. The hydrocarbon product separated from the catalyst particles exits through conduit 12, to downstream processing means (not shown).

The dense bed of catalyst 8 which forms around riser reactor 2 passes down through a conventional stripping zone 9 provided with baffles 10, 10' and is stripped by a stripping gas, such as steam, added via conduit 11. This stripping gas, introduced by conduit 11, performs the primary stripping wherein portions of entrained volatile hydrocarbons are removed to downstream processing means such as a distillation column (not shown), via conduit 12. The spent catalyst from the primary stripping zone is fed downwardly via standpipe 13, controlled by flow control valve 32, where it is again contacted with a secondary stripping gas, preferably steam, entering via conduit 14. The steam and spent catalyst rise upwardly through conduit 15 into the bottom of a secondary stripper 16. The spent catalyst is separated from the secondary stripping gas 14 by means of one or more cyclone separators 17, 17'. Secondary stripper 16 is maintained at a reduced pressure, i.e., preferably at or near atmospheric pressure (101 KPa) so as to facilitate removal of hydrocarbons via conduit 18 to a separate recovery vessel (not shown). It is to be understood that the term "reduced pressure" as used in the specification and claims means "pressure less than that of the reactor vessel." The spent catalyst, now substantially stripped of hydrocarbons has a reduced coke content. This spend catalyst forms bed 19. Stripped, spent catalyst is withdrawn, via standpipe 20, controlled by flow control valve 21, into the bottom of regeneration unit 22.

Regeneration unit 22 is provided with combustion gas, such as air or other oxygen-containing gas, via line 23 such that the coke on the catalyst is burned in the dense phase of catalyst within regenerator 22 and also within the dilute phase transport riser 24 by which the catalyst is transported and discharged, via outlet 25, into disengaging zone 26. A dense bed of hot regenerated catalyst collects around transport riser 24 in the bottom of space 26 and from this point is returned to the reactor via conduit 3 or recycled, via conduit 27, through flow control valve 28, to regenerator 22. Recycle of hot regenerated catalyst, via conduit 27, promotes rapid coke combustion and CO burning in regenerator 22 and riser 24. Flue gas is removed from catalyst disengaging space 22 via conduit 29.

It is a further part of the invention to pressure balance the secondary stripper 16 with regenerator 22 by means of standpipe 20. Secondary stripper 16, operates at a reduced pressure, preferably at or near atmospheric pressure (101 KPa). By contrast, regenerator 22 typically operates at superatmospheric pressure on the order of about 275 KPa. In order to pressure balance the secondary stripper 16 with regenerator 22 use is made of standpipe 20 which contains the spent catalyst. Thus, a head of catalyst of height H provides a static pressure, $\Delta P$ which is equal to the pressure difference existing between secondary stripper 16 and regenerator 22. Thus, in order to calculate the height H of the spent catalyst in standpipe 20 which is required to balance a pressure difference of about 174 KPa, the following formula is used:

$$\Delta P = \rho g H$$

wherein $\rho$ is the density of the spent catalyst in the standpipe and g is a mathematical constant expressing the acceleration of a body due to gravity and in solving for H it is determined to be about 24.4 meters.

Thus the standpipe 20, having a height of about 24.4 meters will be sufficient to pressure balance secondary stripper 16 operating at atmospheric pressure and regenerator 22 operating at superatmospheric pressure on the order of about 275 KPa. This standpipe height of 24.4 meters represents the maximum height required to maintain an atmospheric pressure for the secondary stripper. A slightly higher pressure than atmospheric pressure for the secondary stripper allows a decrease in the required standpipe height.

A typical FCC stripper, currently in operation, operates under the conditions shown in Table 1:

TABLE 1

| Conditions | Typical Stripper Performance TCC | FCC |
|---|---|---|
| Pressure, KPa | 170 | 275 |
| Stripping steam rate, kg/1000 kg catalyst | 3 | 3 |
| Temperature, °C. | 488 | 527 |
| Catalyst residence time, seconds | 1–5 | 20–100 |
| Particle diameter, microns | 3000–6000 | 20–200 |
| Hydrogen in coke, wt % | 5–6 | 6–10 |

It can be seen from the FCC results of Table 1 above, which have been compared to the stripper operation of a conventional TCC unit, that the TCC stripper experiences lower temperature, shorter catalyst contact time, and larger catalyst particles, which are factors contributing to poor stripper efficiency as compared with that of an FCC unit. However, the reduced stripper pressure for the TCC unit, coupled with its plug flow pattern, results in a lower hydrogen-in-coke value, which indicates an improved stripping efficiency.

Typical commercial FCC monitoring data as shown in the following Table 2 confirms the impact of the unit pressure on the amount of strippable hydrcarbons entrained to the regenerator.

TABLE 2

Comparison of Commercial FCC Stripper Performance
Average 1986 Operation

| Commercial Units | A | B | C | D** |
|---|---|---|---|---|
| Stripping Severity, kg/1000 kg Catalyst | 3.10 | 3.00 | 3.43 | 3.35 |
| Riser Top P, KPa | 384 | 301 | 294 | 260 |
| SHC*, % of Coke | 29 | 15 | 12 | 19 |

*SHC = Strippable Hydrocarbons
**higher nitrogen in the feed

From the foregoing Table 2 it can be appreciated that the strippable hydrcarbons, expressed as percent of coke, increased with riser top pressure, expressed in KPa. Commercial unit D traditionally processes hydrocarbons of higher nitrogen content. The higher strippable hydrocarbon at a lower riser top pressure for unit D, which contradicts the anticipated trend, may reflect somewhat the impact of strong nitrogen adsorption onto the catalyst.

These values show that the secondary stripper of the present invention, operating at a reduced pressure, will greatly reduce the hydrocarbon burden on the regenerator by removing a significant portion of the hydrocarbons prior to introduction of the spent catalyst to the regenerator.

Figure 2:
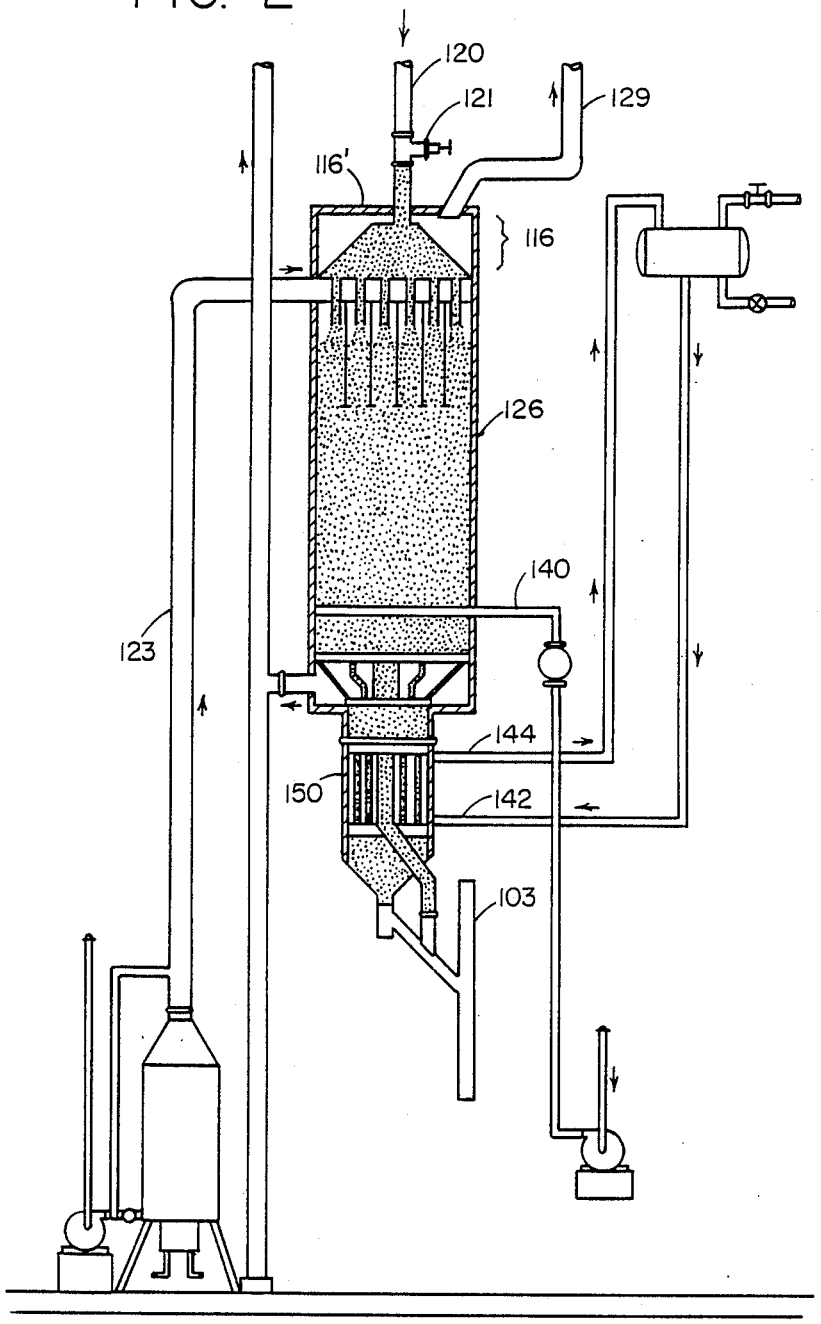
FIG. 2 is schematic represention of a typical TCC regenerator.

Although the foregoing embodiment of the invention has been described with regard to an FCC unit, TCC units also benefit from the present invention of stripping at a reduced pressure. FIG. 2 illustrates a conventional TCC regenerator (hereinafter referred to as kiln) 126 wherein spent catalyst is fed through conduit 120 and flow control valve 121 so as to enter the upper part of kiln 126. Combustion gas such as air or other oxygen containing gas is fed through conduit 123 to kiln 126. The combustion gas may be obtained from any suitable source (not shown). The carbonaceous deposits on the catalyst are burned from the catalyst and the combustion gaseous removed through top flue gas stack 129. Cooling air is fed to the bottom of kiln 126 through conduit 140. A catalyst cooler 150, fed by an indirect heat exchange fluid entering through conduit 142 and exiting conduit 144, reduces the temperature of the burned catalyst to a degree acceptable for returning the regenerated catalyst through lift system conduit 103 to the top of the reactor (not shown) for contacting a hydrocarbon feed. Current TCC strippers (or purge zone) are operated near a reactor bottom plenum pressure of about 170 KPa. The pressure in the kiln top plenum is about 108 KPa.

The provision of a secondary stripper operating at a pressure reduced from 170 to about 108 KPa increases liquid yield. According to the present invention stripping efficiency can be further improved using hot flue gas which increases oxygen content as a stripping medium.

Shown in FIG. 3 is a TCC stripper according to the prior art. The TCC stripper 216 is interposed in the flow path of the catalyst between reactor (not shown) and the kiln 126. The TCC stripper 216 is provided with an annular passage 220 by which the entering catalyst may attain a uniform peripheral velocity. As shown in FIG. 3A, conduit 223 is used to introduce steam to the lower portion of annular flow path 220. This steam contacts the catalyst in annular flow path 220 stripping hydrocarbons entrained by the catalyst entering stripper 216. The stripped catalyst flows downwardly through plenum 225 into conduit 222 and then to the kiln 126. Conduit 224 may also be provided connecting conduit 222 to kiln 126. The plenum 225 is operated at a total pressure of about 170 KPa stripping only some of the hydrocarbon from the catalyst.

FIG. 4 illustrates an embodiment of the invention in which partially stripped catalyst enters secondary stripper 316 through depressuring leg 320 so as to form a bed of catalyst/stripping medium and hydrocarbons as confined by the perforated retaining plate 360. A stripping medium such as steam or flue gas of minimum oxygen content is fed through conduit 323 through flow control valve 330 so as to strip the hydrocarbons from the catalyst. The stripped hydrocarbons are removed through conduit 329 to be processed by downstream processing means, such as a distillation column (not shown). By the provision of depressuring legs 370 and 372, which connect stripper 316 to kiln 126, the pressure in stripper 316 may be reduced to near atmospheric pressure. It is important that the maximum angle $\alpha$ not exceed about 50° which would inhibit flow of the stripped catalyst to kiln 126.

In a further embodiment of the invention shown in FIG. 5, partially stripped catalyst is introduced to stripper 416 located at the top of the kiln through conduit 420 between confining plates 450 and 455. Confining plates 450 and 455 permit the buildup of catalyst/stripping medium/hydrocarbons to a level confined by the perforated retaining plate 460. A stripping medium such as steam or flue gas is fed via conduit 423 along the upper section of air distributor box 470 so as to strip hydrocarbons entrained in the pores of the catalyst within secondary stripper 416. The stripped hydrocarbons are removed via conduit 429 to be processed by downstream processing means, such as a distillation unit (not shown). The stripped catalyst exits secondary stripper 416 through catalyst distribution pipes 471 through 475 connecting stripper 416 to kiln 126. It is important that the angle between the plates 450 or 455 and horizontal axis be greater than about 45°.

Although additional stripping enhancement can be realized by increasing the stripping time to a minimum of about 30 seconds contact time and/or by using a higher temperature stripping medium such as hot flue gas having minimum oxygen content it is preferred to obtain additional improvements by utilizing a bead catalyst having a large amount of 3000 Angstrom pores, preferably ⅓ of its pore volume.

U.S. Pat. No. 2,900,349, which is incorporated herein by reference, teaches how to make a good conventional bead catalyst.

What is claimed is:

1. A process for the fluidized catalytic cracking of a heavy hydrocarbon feed by contacting the feed with a source of hot, regenerated catalyst at catalytic cracking conditions in an upflow, riser reactor to form a mixture of cracked products and spent catalyst containing coke and strippable hydrocarbons, which mixture is discharged from the riser reactor at a riser outlet pressure and separated into a cracked product vapor phase and a spent catalyst phase comprising a dense phase fluidized bed, and said spent catalyst is stripped in a primary stripper by contact with a stripping gas at spent catalyst stripping conditions including a primary stripping pressure to produce a stripped catalyst with a reduced content of strippable hydrocarbons, and said stripped catalyst is charged to a catalyst regeneration zone operating at catalyst regeneration conditions including a regenerator pressure to produce hot, regenerated catalyst which is recycled to the base of the riser to crack said feed characterized in that a secondary stripper is provided intermediate said primary stripper and said regenerator, and said secondary stripper is operated at a reduced pressure relative to both said primary stripper and said regenerator pressure and said second stripper removes additional strippable hydrocarbons from said catalyst by contacting said stripped catalyst with a stripping gas stream at stripping conditions including said reduced pressure.

2. The process of claim 1 wherein the regenerator operates at an elevation and said secondary stripper operates at an elevation which is above said elevation of said regenerator, stripped catalyst is removed from said secondary stripper via a standpipe which collects a height of fluidized catalyst sufficient to create an increase in pressure in said standpipe at a lower region thereof to permit catalyst to flow by gravity into said regeneration zone which is at a higher pressure than said secondary stripping zone.

3. The process of claim 1 wherein the secondary stripping conditions include a catalyst residence time of about 10 to 100 seconds.

4. The process of claim 1 wherein the stripping gas in both the primary and secondary stripper is steam.

5. The process of claim 1 wherein the pressure in said primary stripping zone is the same as the pressure of said riser outlet.

6. The process of claim 1 wherein said secondary stripping is conducted at atmospheric pressure.

7. The process of claim 1 wherein said secondary stripping step comprises passing spent catalyst and stripping gas through cyclones.

8. The process of claim 1 wherein said primary stripping is conducted in a generally vertical stripping vessel, and contains a dense bed of spent catalyst, said dense bed having a vertical length and a diameter, and wherein said length to diameter ratio exceeds 1.

9. A process for the thermofor catalytic cracking of hydrocarbon chargestocks comprising:

(a) contacting hydrocarbon chargestock at cracking temperature and pressure with a circulating inventory of cracking catalyst to produce cracked products and spent catalyst;

(b) recovering products from the spent catalyst and introducing the spent catalyst to an upper end of a regeneration kiln;

(c) contacting the spent catalyst with a stripping gas at a pressure to strip at least some of the entrained hydrocarbons from the spent catalyst at the upper end of the regeneration kiln;

(d) conveying the spent catalyst through a plenum at a lower end of the kiln; and (e) contacting the spent catalyst at the lower end of the kiln with a stripping gas at a pressure lower than the pressure used in the stripping of step (c).

* * * * *